United States Patent [19]

Nordin

[11] 4,114,751

[45] Sep. 19, 1978

[54] PRINTING MACHINE WITH AUTOMATIC OFF-CENTER CROWN ROLLER RIBBON-WEAR COMPENSATION

[75] Inventor: Robert W. Nordin, Skokie, Ill.

[73] Assignee: Teletype Corporation, Skokie, Ill.

[21] Appl. No.: 734,779

[22] Filed: Oct. 22, 1976

[51] Int. Cl.[2] ..... B41J 35/04

[52] U.S. Cl. ..... 400/248; 74/230.01; 74/240; 226/196; 400/236.2; 400/221

[58] Field of Search ..... 197/151, 164, 167, 168, 197/170; 74/230.01, 230.05, 240; 226/196

[56] References Cited

U.S. PATENT DOCUMENTS

| | | | |
|---|---|---|---|
| 1,780,630 | 11/1930 | Page | 197/151 |
| 2,338,414 | 1/1944 | De Sart et al. | 74/240 |
| 2,734,615 | 2/1956 | Van Wallendael | 197/167 |
| 3,143,270 | 8/1964 | Cohen | 226/196 |
| 3,735,940 | 5/1973 | Schwartz | 242/199 |
| 3,814,231 | 6/1974 | Cappotto | 197/168 |
| 3,825,103 | 7/1974 | Riley | 197/164 |
| 3,830,351 | 8/1974 | Cappotto | 197/168 |
| 3,965,765 | 6/1976 | Vaillette et al. | 74/240 |

*Primary Examiner*—Ernest T. Wright, Jr.
*Attorney, Agent, or Firm*—W. G. Dosse; J. C. Albrecht

[57] ABSTRACT

In order to avoid ribbon rollover in a high speed impact printer, a crown roller, having a crown offset from the roller's center, is used to guide the ribbon. The crown tends to center the ribbon about itself and the roller is dimensioned so that the distance from the crown to the end flange of the roller is sufficiently far that under all operating conditions the ribbon will remain separated from the flange and hence will avoid rollover. In particular the roller is positioned so that the print head will initially impact the advancing ribbon off center toward one edge of the ribbon. As printing continues, this repeated impacting will cause that edge of the ribbon to wear, the result being that the tension across the ribbon will decrease and the crown roller will constantly reposition the ribbon as if it were of an ever decreasing width. This constant repositioning (or precision) will present unworn sections of the ribbon to the print mechanism and will simultaneously advance the worn edge toward the flange which is located a distance far enough from the crown to prevent rollover.

3 Claims, 6 Drawing Figures

PRINTING MACHINE WITH AUTOMATIC OFF-CENTER CROWN ROLLER RIBBON-WEAR COMPENSATION

BACKGROUND OF THE INVENTION

This invention relates to a ribbon drive mechanism, especially for high speed impact printers and more particularly to a crown roller structure used in a high speed impact printer.

High speed printers of the type with which the present invention is primarily concerned print "on the fly" at relatively high speeds. More specifically, in one class of printers, the character or font dies are mounted on a continuously moving endless carrier that is drawn past an aligned array of print hammers. Positioned adjacent the dies is the medium (paper) on which the characters are to be printed, and interposed between the medium and the dies is an ink-impregnated ribbon that is continuously moved. In operation, when a print hammer is activated, it causes a font die to impact upon the paper with the ribbon in between. This causes the character on the die to be printed. Hereinafter the die and the associated print hammer will be referred to as the print head.

Because of the high speed nature of such printers, incremental movement of the ribbon is precluded. Further, the ribbon advance mechanism is required to be of the reversing type and should operate relatively maintenance free. One appropriate ribbon advance mechanism meeting these objectives is described in a patent issued to Arthur F. Riley, U.S. Pat. No. 3,825,103, assigned to the assignee hereof, entitled "High Speed Printer Having Improved Ribbon Driving, Reversing and Tensioning Mechanism".

In order to operate economically, it is obvious that the ink on the ribbon should be utilized as completely as possible before the ribbon is replaced. As a result, it is advantageous for the entire width as well as the entire length of the ribbon to be exposed to impacting by the print head. It is also necessary for the ribbon to remain parallel to the printing medium (paper). However, it has been found in using printers such as the one described in the above-mentioned Riley patent that under certain conditions uneven ribbon wear at one edge results in elongation of the fibers causing the ribbon to rub against the flange of one or more ribbon guide rollers and eventually rollover, forming a double layer of ribbon adjacent the paper. Accordingly, the print head can impact upon the double layer, no ribbon at all, or a combination of folded ribbon and no ribbon, depending upon the relative positions of the folded ribbon and the print head. In any of these cases the printing is distorted.

It is therefore a principal object of the invention to provide a ribbon advance mechanism to prevent this rollover which distorts and destroys the printing capability.

It is also an object of the present invention to insure that the maximum area (width) of the ribbon be used for printing.

It is a further object to provide a ribbon advance mechanism which is not adversely affected by the wear or elongation imparted to the ribbon by the repeated impact of the print head.

SUMMARY OF THE INVENTION

In accordance with the present invention the ribbon advance mechanism avoids the ribbon rollover by the use of offset crown rollers. The offset crown effectively senses the wear of the ribbon and constantly tends to reposition the center of the unworn portion of the ribbon in alignment with the offset crest of the crown, thereby providing relatively unworn, unstretched ribbon in the vicinity of the print head for use in subsequent printing.

The offset crown roller acts as the final ribbon guide immediately prior to the printing traverse of the ribbon before the print head. The crest or largest diameter of the crown is offset from the midline between the two end flanges of the roller. The roller is positioned so that impact upon an unworn ribbon begins at one edge of the ribbon; and as wear occurs due to repeated impact, the ribbon is constantly recentered and advanced toward one flange. The flange toward which the ribbon advances is spaced from the center or crest of the crown by a distance sufficient that the ribbon will not reach the flange and hence not impart any pressure to cause rollover.

BRIEF DESCRIPTION OF THE DRAWING

A more complete understanding may be had of the present invention by referring to the following detailed description when considered in conjunction with the accompanying drawing wherein like reference numbers refer to the same or similar parts throughout the several views in which.

DETAILED DESCRIPTION

Figure 1:
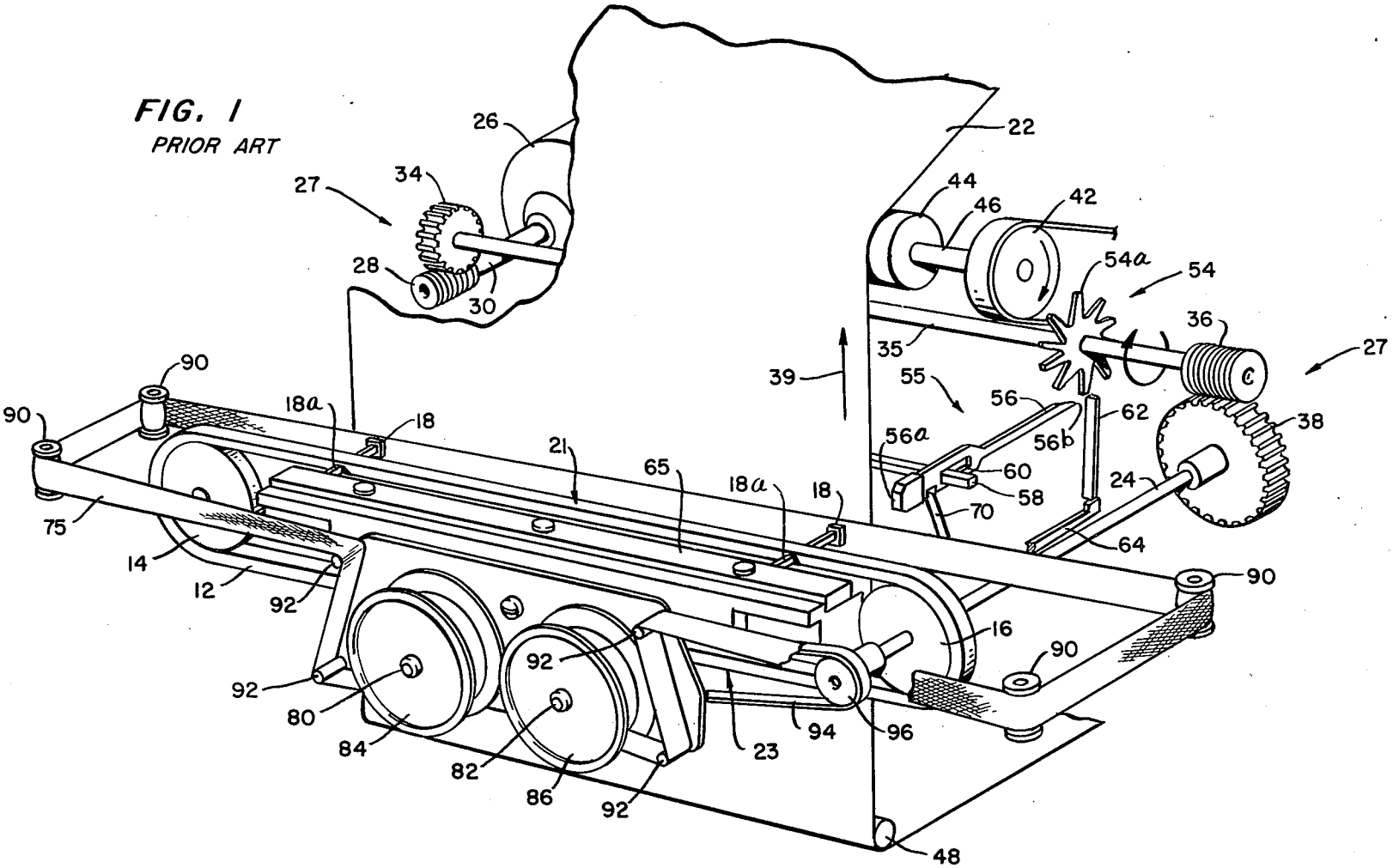
FIG. 1 PRIOR ART
FIG. 1 illustrates a high speed printer and tape advance mechanism of the prior art.

Referring now to the accompanying drawing and more particularly to FIG. 1 there is shown a printer mechanism representative of a high-speed impact printer and which is particularly illustrative of the Teletype® model 40 printer marketed by Teletype Corporation, Skokie, Illinois. This printer utilizes an endless carrier 12, entrained about a pair of spaced pulleys 14 and 16, which are oriented for rotation in a common vertical plane by means of suitable journals (not shown). The carrier 12 is adapted to transport a plurality of pallets 18 (only two being shown) in an essentially flat, oval path which is oriented in a vertical plane so as to define an upper printing traverse in the area generally defined by the numeral 21 and a lower return course in the area defined by the numeral 23.

The pallets 18 have a front face portion upon which an alphanumeric character die (not shown) is secured or otherwise formed as an integral part thereof. The character dies on the pallets 18 are oriented to address a print medium or paper 22. Each pallet 18 is secured to the carrier 12 and uniformly spaced therealong by means of an integral shank portion 18*a* that extends through suitable apertures (not shown), formed in the carrier 12, and which are oriented in a direction transverse to the longitudinal axis thereof.

The carrier pulleys 14 and 16 constitute idler and drive pulleys, respectively. Driving torque is continuously transmitted to the pulley 16 by a shaft 24 which is coupled to a prime mover, herein shown as a motor 26, through a drive train designated generally by the reference numeral 27. The drive train 27 includes a worm gear 28, secured to a shaft 30 of the motor 26. A gear 34 meshes with the worm gear 28 and is secured to one end of an elongated drive shaft 35. A worm gear 36 is secured to the other end of the drive shaft 35 and rotates therewith. A gear 38 meshes with worm gear 36. Gear 38 is secured to the same shaft 24 as is the drive pulley 16.

The print medium or paper 22 advances in the direction shown by an arrow 39, normally by a distance equal to one line at a time. This incremental advancement of the medium 22 is effected by a drive mechanism coupled to a pulley 42 which in turn is coupled to a roller or platen 44 via a shaft 46. The rotation of the pulley 42 in the intermittent mode is accomplished by a conventional control and drive means (not shown) which may be coupled to, for instance, the shaft 24 by a conventional clutch mechanism (not shown). The roller or platen 44 is disposed transverse of and adjacent to the path of the medium 22 so as to frictionally engage the medium or paper 22 and, in cooperation with other conventional guide means (not shown) to cause the medium 22 to intermittently feed from a supply source (not shown) about a lower guide cylinder 48 as the medium 22 is advanced in the direction of the arrow 39. Alternatively, the friction roller or platen 44 may be replaced by sprockets which conventionally engage suitable holes which may be preperforated along the edges of the paper 22.

In the illustrative embodiment shown, the character printing mechanism further comprises an array of spokelike impeller wheels 54 (only one is shown) which are spaced along and concentrically secured to the longitudinally-extending drive shaft 35. A plurality of respectively associated impacters (only one is shown) designated generally by the reference numeral 55 cooperate with their associated impeller wheels 54. Each impeller wheel 54 has a plurality of radially-extending, uniformly-spaced, spokelike impeller elements 54*a*, all of which are oriented in a common plane perpendicular to the axis of shaft 35.

Each impacter 55 includes a hammer 56 mounted in a channel (not shown) forming part of the printer frame so that it may be driven in a direction perpendicular to the medium 22 between a normal, untensioned, or non-printing position, and a printing position whereat an enlarged forward head portion or face 56*a* of each hammer 56 contacts the backside of the medium or paper 22.

In order to facilitate accurate printing, it is apparent that each hammer 56 must be axially aligned with the appropriate pallet 18 mounted on the moving carrier 12. Therefore, the continuous movement of the pallets 18 along the upper printing traverse 21 extending across the width of and closely adjacent to the front side of the medium or paper 22 makes it possible for each pallet 18 (with a character die on the front face thereof), or groups thereof, to be successively brought into momentarily axial alignment with the hammers 56.

To affect selective driving of hammers 56 against the medium or paper 22 with sufficient force to print characters thereon, a horizontal bumper in the form of a fixed rod 58 is disposed to align a slot 60 formed in each of the hammers 56 for limiting the movement of the hammer 56 and for controlling its initial position. The agency by means of which each of the impeller wheels 54 drives an aligned hammer 56 against the back side of the medium or paper 22 comprises an interponent 62 (only one is shown). Each of the interponents 62 essentially comprises an elongated upright finger-like member, and is aligned and operably associated with one particular impeller wheel 54 and associated hammer 56.

The interponents 62 are disposed in a lateral array, parallel to and respectively adjacent the free rearward ends 56*b* of their associated hammers 56. When the interponent 62 is in a vertically raised position, as controlled by a selector mechanism represented by an armature extension 64, it lies in the path of movement of the then immediately adjacent impeller spoke-like element 54*a*, and the force from the rotating impeller 54 is transmitted via the interponent 62 to the rear end 56*b* of its associated hammer 56 in consequence of which printing occurs by driving the face 56*a* into the medium or paper 22 which is then pressed against the die or type face of the type pallet 18. The required compressive pressure between the hammer face 56*a* and the pallet 18 may be further insured by inclusion of back-up bar 65 against which the shank portion 18*a* is pressed upon impact by the hammer 56.

A plurality of leaf springs 70 (only one is shown) are respectively associated with the hammers 56. The spring 70 is in a normally unbiased condition. However, when the hammer 56 is driven forward by the action of impeller wheel 54 and interponent 62, the spring 70 urges the hammer 56 to return to its initial or rest position, which rearward movement occurs after the rearward free end 56*b* of the hammer 56 has been released by its associated interponent 62.

The alphanumeric character to be printed at the given location on the paper 22 is determined by the timing of the movement of interponent 62 in relation to the position of the carrier 12. However, unless special, expensive, impact-sensitive paper is used as the medium 22, the printing requires the interposition of an inked ribbon 75 between the type pallet 18 and the medium 22 in order to produce any visible printing. Accordingly, such as ribbon 75 having a finite width and indeterminate length is continuously moved between the pallets 18 and the medium 22. This ribbon 75 should be tensioned, its motion should be reversed when an end of the ribbon 75 is reached, and it should be maintained in proper spaced relationship with the pallets 18. To this end a ribbon drive mechanism is provided.

Two drive shafts 80 and 82 alternately function as drive and idler shafts. The shafts 80 and 82 are each rotatably mounted at one end on a suitable frame support and respectively carry at their free ends two ribbon spools 84 and 86. The ribbon 75 is payed out from one of the spools 84 or 86 and taken up by the other after having been drawn along a circuitous path defined by a set of generally barrel-shaped, vertically positioned guide rollers 90 rotatable about vertical axes and a set of horizontally positioned guide rollers 92. All of the rollers 90,92 have contours that are defined by smooth surfaces of revolution about their axes. It can be seen that the two sets of guide rollers 90,92 arranged in the manner shown in FIG. 1, insure that as the ribbon 75 travels from one spool 84 to the other, it passes closely adjacent the medium 22 and is oriented in the vertical plane parallel therewith and positioned between the pallets 18 and the medium 22 in the vicinity of the printing traverse 21. The shafts 80 or 82 are driven by means of a belt 94 driven by a pulley 96 which is secured to the shaft 24. A reversing mechanism (not shown) causes the drive belt 94 alternately to drive the shaft 80 or the shaft 82. The alternatively nondriven shaft 80 or 82 is provided with a spring mechanism (not shown) to maintain tension in the ribbon 75.

Figure 2A:
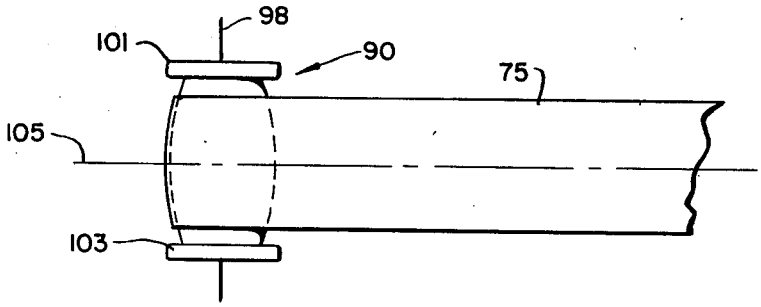
FIG. 2a PRIOR ART
FIGS. 2(*a*) and 2(*b*)show, in particular a segment of (a) a new, unworn ribbon passing around a prior-art crowned roller and (b) a worn, upper-edge-stretched segment of ribbon exhibiting an adverse rollover effect.
Figure 2B:
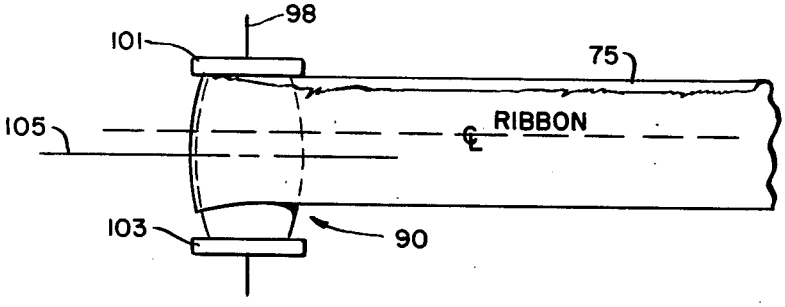
FIG. 2b PRIOR ART

The ribbon drive mechanism described provides a guide to assure that the ribbon 75 is properly positioned with regard to the pallets 18. It also provides a reversing mechanism operative when the entire length of ribbon 75 has been payed out and it provides tensioning. However, it has been discovered that the guide arrangement shown in FIG. 1 exhibits an undesirable characteristic after the ribbon 75 wears. This is illustrated more clearly in FIGS. 2(*a*) and 2(*b*) in which only one of the rollers 90 with its axis 98 and a segment of the ribbon 75 are reproduced. All four of the guide rollers 90 are crown rollers, each having two end flanges 101 and 103, respectively, at their extremities and minor diameters. The crown crest, or major diameter of a crown roller 90 is conventionally located at the centerline 105 midway between the flanges 101 and 103. As is characteristic of crown rollers 90, a new ribbon 75 centers itself upon the centerline 105 of the crown as it passes over each of the rollers 90 such as the example shown in FIG. 2(*a*). Unfortunately, as impact from the print head (combination of the pallet 18 and hammer 56) repeatedly compresses the ribbon 75, it causes a wearing and a resultant stretching of the longitudinal fibers of the ribbon 75. The position of the two rollers 90 which establish the path which the ribbon 75 travels in the vicinity of the printing traverse 21 are arranged so that one is elevated relative to the other. Accordingly, the ribbon 75 is diagonally disposed with respect to the horizontal line on which the pallets 18 lie. Therefore, the pallets 18 on one end of the printer impact the lower portion of the ribbon 75 while the pallets 18 on the other end of the printer impact the upper portion of the ribbon 75. This assures significant usage of the full width of the ribbon 75, thereby prolonging the life of a given ribbon 75.

However, this impacting at the edges causes the ribbon 75 to wear unevenly relative to the ribbon's centerline. This provides reduced tension across the narrow dimension of the ribbon 75 with the resultant effective width being reduced as wear increases. The result is that the ribbon 75 stretches differently longitudinally at different points across the ribbon's narrow dimension. Therefore, since rollers 90 are crown rollers, the ribbon 75 migrates towards one flange (for example, flange 101) or the other (toward the edge having the greatest wear). Eventually one edge of the migrating ribbon 75 comes into contact with one flange 101 of roller 90 (FIG. 2(*b*). Interferences between one edge of the ribbon 75 and its adjacent roller flange (for example, flange 101) causes the ribbon 75 to bunch up and subsequently fold or roll over.

Returning to FIG. 1, it is evident that rollover could occur at any roller (such, for example, as the rollers 90), but the greatest likelihood for rollover is between vertical rollers 90 and horizontal rollers 92 wherein the ribbon 75 experiences a 90° twist. The effect of lateral wear on the ribbon's effective width and the resultant movement of the ribbon 75 relative to the midpoint or crown of the rollers 90 is, however, applicable to each of the rollers 90. Consequently, if the final roller 90 prior to entry into the printing traverse 21 transmits or carries a folded or rolled-over ribbon configuration, the printing will be distorted either by the double thickness of ribbon, no ribbon, adjacent the pallet 18, or a combination of both.

Figure 3:
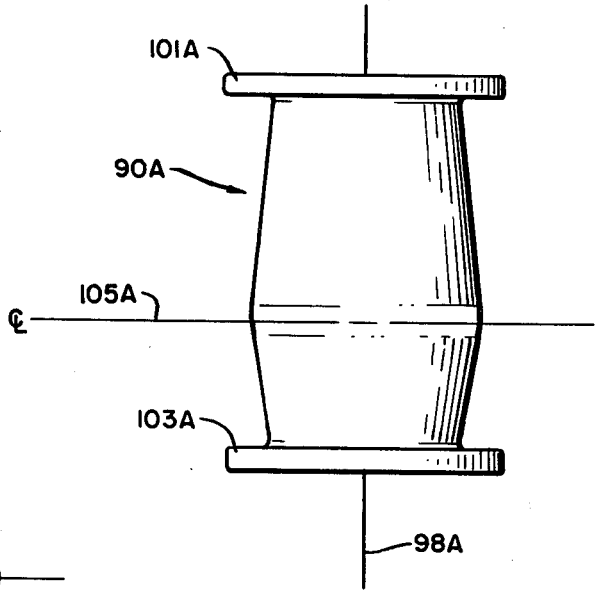
FIG. 3 is a diagram of an offset crown roller in accordance with the present invention.

FIG. 3 illustrates an improved, generally barrel-shaped crown roller 90A according to the present invention. Two flanges 101A and 103A abut the ends of the crown roller 90A. The centerline 105A of the crest or major diameter of the crown roller 90A is not located midway between the flanges 101A and 103A but is offset or displaced towards one of them (for example nearer to the flange 103A and farther or more remote from the flange 101A). The minimum or minor diameter of the roller 90A is located at at least one of the flanges. (101A or 103A)

Figure 4A:
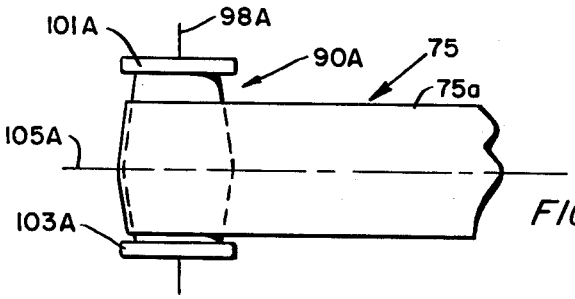
FIGS. 4(*a*) and 4(*b*) are diagrams similar to FIGS. 2(*a*) and 2(*b*) but illustrating the use of the offset crown roller of FIG. 3 to prevent rollover and to cause constant repositioning of the ribbon from (*a*) the new, unworn condition to (b) the worn condition in accordance with the present invention.
Figure 4B:
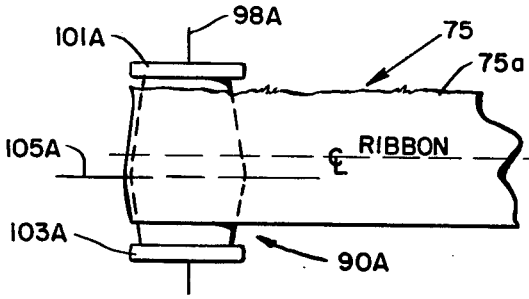

FIGS. 4(*a*) and 4(*b*) illustrated roller and ribbon interaction in accordance with the present invention. In this case the roller such as 90A, which replaces rollers 90 and/or 92 in FIG. 1, has the offset crown illustrated in FIG. 3. The rollers 90A are mounted to rotate about their associated axes 98A which may differ slightly from the skewed axes 98 which guided the ribbon 75 at an angle past the upper printing traverse 21. A new ribbon 75 tends to be centered about the offset centerline 105A of the crown as shown in FIG. 4(*a*) with substantially half its width positioned between the flange 103A and the centerline 105A of the major diameter of the roller 90A. As the ribbon 75 wears and stretches, as illustrated, at one edge 75(a) in FIG. 4(*b*), the actual centerline of the ribbon 75 moves upward relative to the crown centerline 105A since the effective width of the ribbon 75 bearing against the surface of the roller 90A has been reduced by the wear and stretching in the area of the edge 75(a). If the ribbon 75 is guided so that the pallet 18 impacts upon principally the upper portion near the edge 75(a) of a new ribbon 75, it is seen from comparing FIGS. 4(*a*) and 4(*b*) that the wearing causes the ribbon 75 to migrate upward toward the flange 101A providing a fresher zone of ribbon 75 in place of the worn and stretched zone.

It is evident that with the improved rollers 90A, the ribbon 75 should be guided in a path parallel to the line of the pallets 18 in FIG. 1 and that the pallets 18 should strike the upper portion of a new ribbon 75, as viewed in FIG. 4(*a*). In this case it should be located between the crown centerline 105A and flange 101A. Therefore, when the impact causes wear and stretch of the ribbon edge 75(*a*), the ribbon 75 migrates in the direction of flange 101A. It will thus be evident to one skilled in the art that this flange 101A should be the furthest from the crown centerline 105A of the improved roller 90A, inasmuch as it is desired to prevent the ribbon 75 from making contact with this flange 101A and hence prevent the folding rollover problem illustrated in connection with FIG. 2(*b*).

It is desirable then to place the pallet impact initially at the edge 75(*a*) of the ribbon 75 as shown in FIG. 4(*a*) so that it will cause the ribbon 75 to wear and stretch at the edge 75(*a*) and subsequently migrate in one direction. Further, it is advisable that the separation between the crest or crown centerline 105A and the flange 101A toward which the ribbon 75 will migrate be sufficient to accommodate the ribbon 75 after the greatest permissible wear has occurred.

While the above invention has been described in terms of line-at-a-time printers and a particular line-at-a-time printer in which the hammer 56 and pallet 18 are on opposite sides of the paper 22 so that the paper 22 is actually impacted into the ribbon 75 and thence into the pallet 18, it is obvious that the present invention relating to the roller configuration and to the ribbon advance mechanism is equally applicable to printers of other types. More generally the use of a moving carrier 12 containing pallets 18 is not necessary for the application of the present invention. While the above invention has been described in terms of a specific printer embodiment, it is evident that this is merely illustrative of the principles and purposes of the invention and one skilled in the art may make modifications and still remain in the spirit and scope of the present invention.

What is claimed:

1. An improved printing machine wherein an inked ribbon is passed between a record medium and type dies for squeezing the inked ribbon between the record medium and the type dies, thereby wearing and stretching the ribbon wherever the ribbon is so squeezed, means for drawing the ribbon lengthwise past the type dies, at least one crown roller for turning the direction of the ribbon and for guiding the ribbon in its width dimension, the crown roller having a generally barrel shape with two ends, a major diameter, and a minor diameter, wherein the improvement comprises:

the two ends of the crown roller spaced apart by a distance substantially greater than the width of the ribbon;

the major diameter of the crown roller being located closer to a near end than a far end of the crown roller;

the major diameter of the crown roller positioned to locate a new ribbon so as to squeeze the new ribbon principally nearer a first ribbon edge closer to the far end of the crown roller, whereby the ribbon nearer the first edge of the ribbon is stretched; and sufficient space between the first edge of the ribbon and the far end of the crown roller to accommodate the ribbon as through wear and stretching the ribbon migrates on the crown roller to bring a second edge of the ribbon, opposite the first edge of the ribbon, toward the major diameter of the crown roller, thereby locating a worn ribbon so as to squeeze the worn ribbon principally less near the first edge of the ribbon.

2. An improved mechanism for advancing and guiding an inked ribbon having a predetermined width and an indeterminate length, past a printing position including a crown roller having an axis and a smooth surface of revolution about the axis having a major diameter and a minor diameter with two end flanges spaced a distance apart substantially greater than the width of the ribbon, wherein the improvement comprises:

the major diameter of the crown roller located closer to one flange than the other flange;

the major diameter of the crown roller located, with respect to the printing position, to print with a new ribbon principally nearer a first ribbon edge nearer the other flange of the crown roller; and sufficient spacing between the major diameter of the crown roller and the other flange of the crown roller to accommodate the ribbon as the ribbon migrates toward the other flange with wear and stretching so as to bring into the printing position a portion of the ribbon located nearer the one flange of the crown roller.

3. An improved mechanism according to claim 2 wherein the crown roller is positioned with the center line of the printing position between the major diameter of the crown roller and the other flange of the crown roller.

* * * * *